US005156377A

United States Patent [19]

Nishimura

[11] Patent Number: 5,156,377

[45] Date of Patent: Oct. 20, 1992

[54] LEVER-OPERATED HOIST

[75] Inventor: Yosaku Nishimura, Osaka, Japan

[73] Assignee: Vital Kogyo Kabushiki Kaisha, Osaka, Japan

[21] Appl. No.: 615,850

[22] Filed: Nov. 20, 1990

[30] Foreign Application Priority Data

Nov. 25, 1989 [JP] Japan ..... 1-306121

[51] Int. Cl.[5] ..... B66D 1/14

[52] U.S. Cl. ..... 254/346; 254/352; 254/372; 192/43.1; 192/93 A

[58] Field of Search ..... 254/352, 353, 357, 346, 254/369, 372; 112/279; 192/43.1, 93 A, 20, 21, 95

[56] References Cited

U.S. PATENT DOCUMENTS 4,468,005 8/1984 Nakamura ..... 254/352 X
4,469,308 9/1984 Nakamura et al. ..... 254/353 X
4,479,635 10/1984 Maeda ..... 254/353 X
4,819,913 4/1989 Nishimura ..... 254/353 X

*Primary Examiner*—Katherine Matecki

*Attorney, Agent, or Firm*—Mason, Fenwick & Lawrence

[57] ABSTRACT

A lever-operated hoist having a structure for continuously lowering the lower hook side chain and end side chain of load chains in no-load state comprising a pressure drive member movably screwed in the axial direction on a drive shaft, a rotation limiting member spline-fitted on the drive shaft adjacently to the pressure drive member, and an operation wheel rotatably disposed on the rotation limiting member, a first projection and a second projection extending in the radial direction are disposed at specified intervals in the circumferential direction at the outer end face in the axial direction of the pressure driving member, two circumferential spaces are divided and formed by them, and the rotation limiting protuberance of the rotating limiting member and the pressure release protuberance of the operating wheel are projecting into these two spaces. By the impact action or abutting action of these two protuberances to the first projection, rotation stop of the pressure drive member in no-load operation and contact with other member may be prevented, so that smooth and continuous chain operation may be realized.

4 Claims, 7 Drawing Sheets

LEVER-OPERATED HOIST

BACKGROUND OF THE INVENTION

1. Field of the Invention

The invention relates to a lever-operated hoist, and more particularly to a lever-operated hoist having a structure for continuously pulling down not only the chain at the side being coupled with the lower hook of the load chain, but also the chain at the side not coupled, in a no-load state.

2. Description of the Prior Art

A conventional lever-operated hoist was provided with an operation lever for continuously pulling down the load chain in a no-load state, that is, in a state having no load applied on the lower hook of the load chain.

In such no-load state, when pulling down the lower hook, by operation lever is manipulated to depart the pressure drive member from the friction member so as to be cleared also from other members, and in this state the chain of the lower hook side is moved downward. On the other hand, when pulling down the chain at the side of the end not coupled with the lower hook (at this time, the chain of the lower hook side is pulled up), the operation lever is manipulate to depart the pressure drive member from the operating wheel, and the end side chain is moved downward.

However, as mentioned below, such operation lever structure was not able to pull down the load chain continuously in no-load state, actually, and its improvement has been demanded.

That is, in no-load state, when the lower hook side chain is pulled down and the drive shaft is rotated, the pressure drive member slidably screwed into the drive shaft should ideally rotate together with the drive shaft en bloc, but actually it rotates slightly behind the rotation of the drive shaft due to inertia. In this case, the pressure drive member rotates relatively on the drive shaft to move in the direction of pushing the friction member. Thus, the reverse rotation preventive wheel and the pressure bearing member fixed on the drive shaft are combined into one body to stop rotation of the drive shart in the hoisting-down direction. As a result, rotation of the load sheave coupled with the drive shaft is stopped, and the lower hook cannot be moved downward. Consequently, every time the lower hook stops moving, it is necessary to manipulate the operation lever to depart the pressure drive member from the friction member.

To the contrary, when pulling down the end side chain, the pressure drive member moves in the direction of contacting with the operating wheel reversely to the case above, and contacts flatly with the end surface of the operating wheel. In this case, since the rotating action of the operating wheel is somewhat receiving a resistance in relation with the operation lever, the rotation of the drive shaft itself receives also resistance through the pressure drive member. Accordingly, the end side chain can be hardly pulled downward, and it is every time necessary to repeat the operation of manipulating the operation lever to pull the pressure drive member from the operating wheel.

BRIEF SUMMARY OF THE INVENTION

It is hence a primary object of the invention, in the light of the problems of the prior art, to present a novel lever-operated hoist solving the above problems.

It is other object of the invention to present a lever-operated hoist capable of continuously pulling down the lower hook side chain and end side chain, without departing the pressure drive member from the friction member or operating wheel by operation lever in no-load state.

It is another object of the invention to present a lever-operated hoist capable of continuously pulling down the load chain, by blocking the stopping of rotation of the pressure drive member due to inertia or the like to prevent movement of the drive shaft of the pressure drive member in the axial direction, in the midst of pulling down the lower hook side chain and end side chain in no-load state.

These and other objects of the invention as well as the features and advantages thereof will be better appreciated and understood from reading of the detailed description taken in conjunction with the accompanying drawings and novel points indicated in the claims.

BRIEF DESCRIPTION OF THE DRAWINGS

FIG. 6 to FIG. 10 are front views of essential parts showing the state of each operation of the same lever-operated hoist, in which FIG. 6 shows the state of hoisting up the load, FIG. 7 when hoisting down the load, FIG. 8 when changed to no-load state, FIG. 9 when rotating the operating wheel in the hoisting-down state in no-load state, and FIG. 10 when the end side chain is pulled down in no-load state.

DETAILED DESCRIPTION OF THE PREFERRED EMBODIMENT

Figure 1:
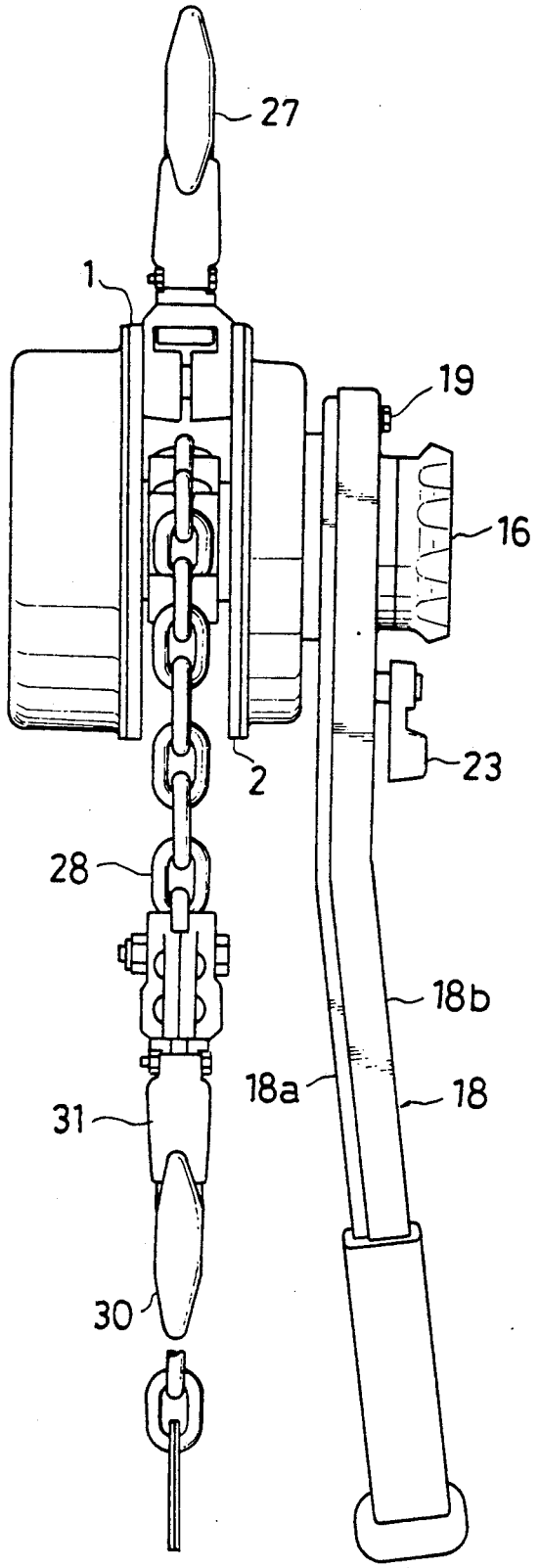
FIG. 1 is a side view of a lever-operated hoist according to one of the embodiments of the invention.
Figure 2:
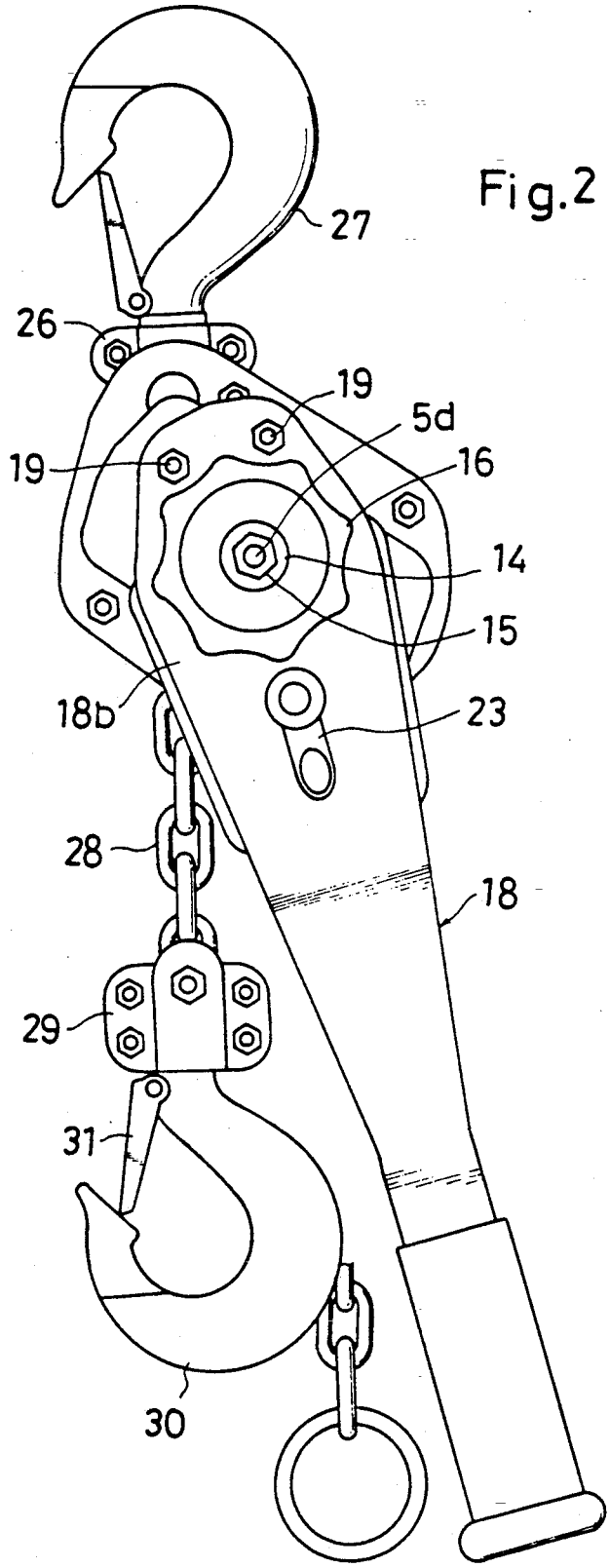
FIG. 2 is a front right view of the same lever-operated hoist.
Figure 3:
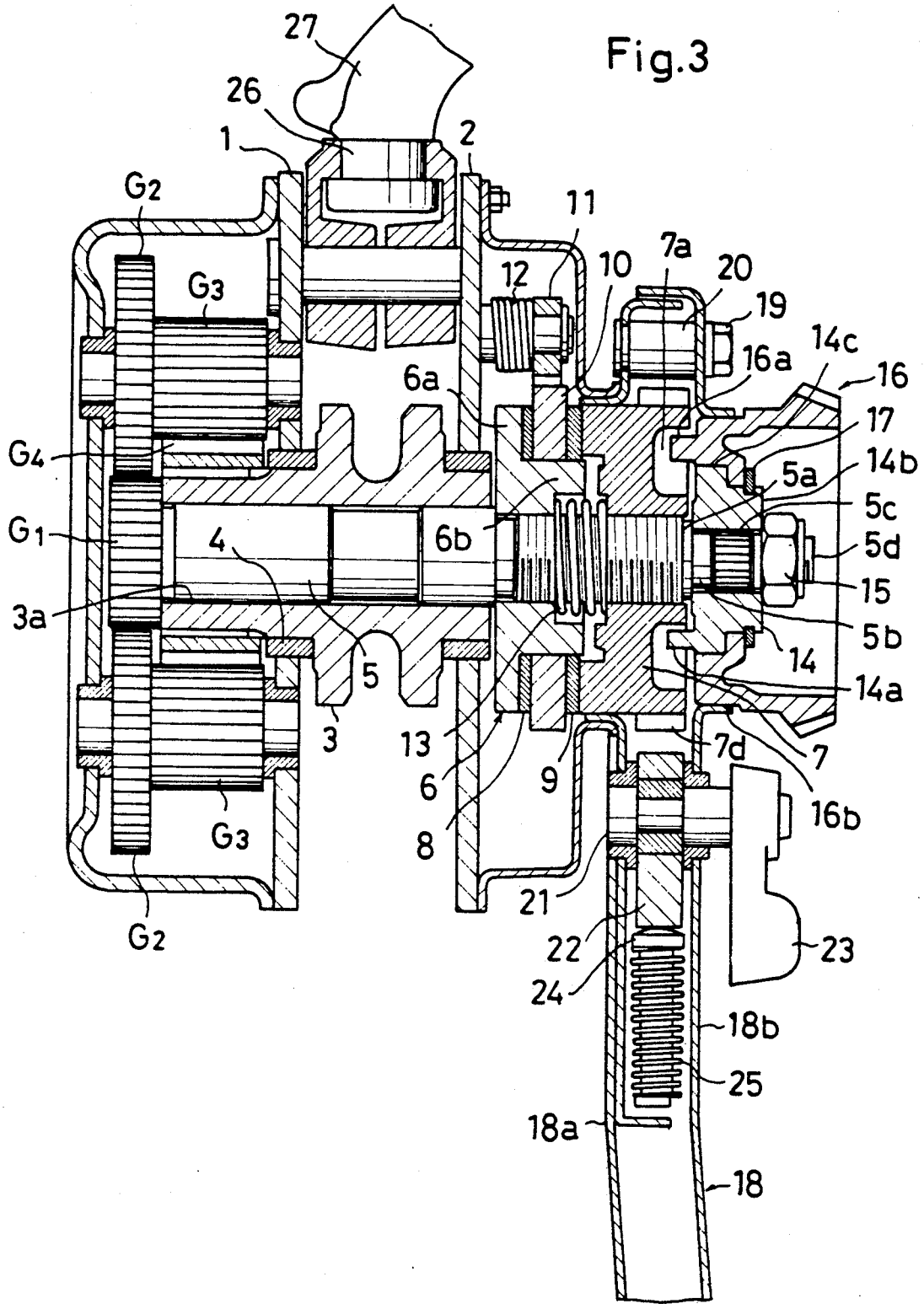
FIG. 3 is a longitudinal sectional view magnifying essential patts of the same lever-operated hoist.

In FIG. 1 and FIG. 3, in the middle of side plates 1, 2 held parallel at a specific spacing, a load sheave 3 is rotatably held by bearings 4, 4. A shaft hole 3*a* is provided in the central part of the load sheave 3, and a drive shaft 5 is inserted and supported therein. Both ends of the drive shaft 5 are projecting from the load sheave 3, and on the outer circumference of one projection thereof, sequentially from the side nearer to the side plate 2, first screw part 5*a*, shaft part 5*b*, spline part 5*c*, and second screw part 5*d* are formed. At the other projection of the drive shaft 5, a pinion shaft $G_1$ is affixed, which is linked to the load sheave 3 through known reduction gear transmission lines $G_2$, $G_3$ and $G_4$.

In the first screw part 5*a* of the drive shaft 5, a pressure bearing member 6 is screwed and fixed from the side closer to the side plate 2, while a pressure drive member 7 is screwed slidably in the axial direction. The pressure bearing member 6 is composed of a disk part 6*a*, and a boss part 6*b* projecting out in the axial direction from its middle part, and the disk part 6*a* is adjacent to the side plate 2, and is screwed and fixed to the deepest part of the first screw part 5*a*. In the boss part 6*b*, a pair of friction members 8, 9 and an intervening reverse rotation preventive wheel 10 are disposed.

The reverse rotation preventive wheel 10 has detent teeth inclining in one circumferential direction. The reverse rotation preventive wheel 10 and the friction members 8, 9 disposed at both sides thereof are designed to be pressed against the disk part 6*a* by the pressure drive member 7 disposed opposite to the pressure bearing member 6. Numeral 11 is a ratchet pawl pivoted on the side plate 2 and pressed to the outer circumference of the reverse rotation preventive wheel 10 by a spring 12, and this ratchet pawl 11 is engaged with detent teeth of the reverse rotation preventive wheel 10, thereby arresting the reverse rotation preventive wheel 10 rotatably only in the hoisting-up direction of the load sheave 3.

A thrusting member 13 is inserted between the hole formed in the end surface of the boss part 6*b* of the pressure bearing member 6 and the opposing pressure drive member 7, and the pressure driving member 7 is always thrust outward in the axial direction by it.

Adjacent to the pressure drive member 7, a rotation limiting member 14 is spline-fitted to the spline part 5*c* of the drive shaft 5, and is fixed to the drive shaft 5 by a nut 15 screwed into the second screw part 5*d*. The rotation limiting member 14 has a rotation limiting protuberance 14*a* getting into an annular hole 7*a* formed in the pressure drive member 7, disposed at the end face confronting the pressure drive member 7, and a boss part 14*b* outward in the axial direction.

Between the boss part 14*a* of the rotation limiting member 14 and the outer circumference 14*c*, an operating wheel 16 is rotatably fitted to the rotation limiting member 14. This operating wheel 16 is held so as not to drop off the rotation limiting member 14, by a snap ring 17 fitted in the groove part of the rotation limiting member 14. In the annular end face of the operating wheel 16 confronting the pressure drive member 7, there is a pressure release protuberance 16*a* getting into the annular hole 7*a* in the pressure drive member 7.

In the part of the annular hole 7*a* of the pressure drive member 7, first projection 7*b* and second projection 7*c* for distinguishing the rotation limiting protuberance 14*a* of the rotation limiting member 14 and the pressure release protuberance 16*a* of the operating wheel 16 are stretching in the radial direction. The central angles of the two parts of the annular hole 7*a* divided by these first projection 7*b* and second projection 7*c* are mutually different significantly as shown in FIG. 4.

Figure 4:
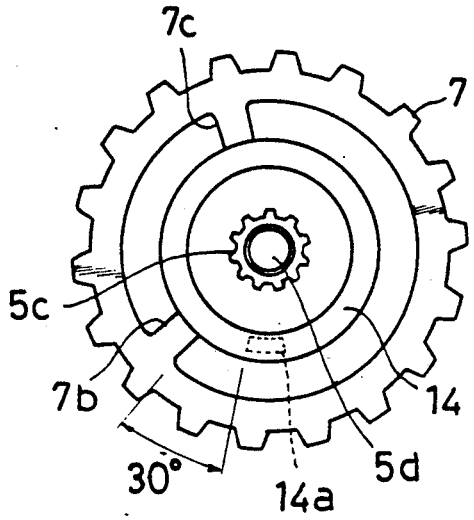
FIG. 4 is a front view showing the positioning relation between pressure drive member and rotation limiting member of the same lever-operated hoist.
Figure 5:
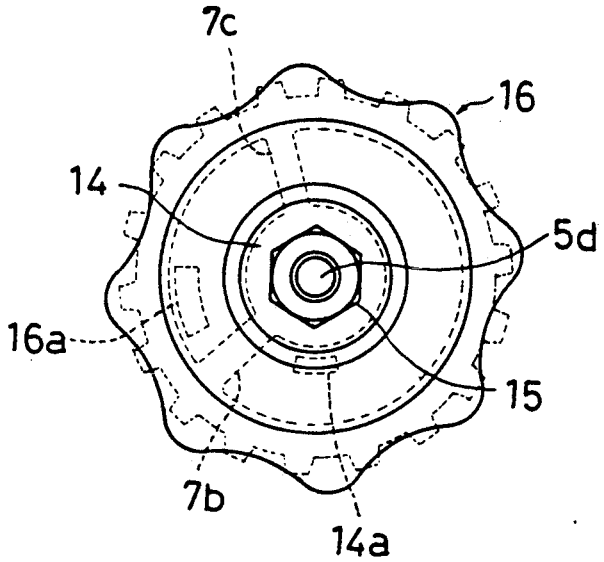
FIG. 5 is a front view showing the fitted state of operating wheel in the state shown in FIG. 4.

Positioning of the rotation limiting member 14 of the pressure drive member 7 is achieved by fitting to the spline part 5*c* of the drive shaft 5 so that the rotation limiting protuberance 14*a* may form an angle of about 30° C. at the rotation side of the hoisting-down direction to the first projection 7*b* of the pressure drive member 7 (see FIG. 4). The operating wheel 16 is fitted into the outer circumference of the rotation limiting member 14 so that the pressure release protuberance 16*a* may be positioned on the opposite side of the rotation limiting protuberance 14*a* with respect to the first projection 7*b*, and then the snap ring 17 is fitted in.

The pressure drive member 7 has the part of the gear 7*d* housed within the operation lever 18. This operation lever 18 is composed of separately formed inside lever case 18*a* and outside lever case 18*b*. The inside lever case 18*a* has an opening for inserting the friction member 9 side of the pressure drive member 7. To this inside lever case 18*a*, the outside lever case 18*b* is integrally coupled by means of a plurality of screws 20, 20, . . . , and nuts 19, 19, . . . In the outside lever case 18*b*, in the part corresponding to the cylindrical outer circumferential part 16*b* of the operating wheel, an opening to be inserted and supported therein is disposed.

The operation lever 18 is extended to the lower side of the pressure drive member 7, and a rotating direction changeover pawl 22 is disposed inside thereof. The rotating direction changeover pawl 22 is rotatably supported on both lever cases 18*a*, 18*b* by means of a shaft 21. The shaft 21 projects outside of the operation lever 18, and a handle 23 is attached to this projecting part. By the changeover operation of the handle 23, the rotating direction changeover pawl 22 is engaged to rotate the pressure drive member 7 either in hoisting-up direction or hoisting-down direction, or is held in the neutral position not to rotate in either direction. At the lower end of the rotating direction changeover pawl 22, a pressure member 24 thrust upward by a spring 25 is abutting, so that the rotating direction changeover pawl 22 may be elastically held in the specified changeover position.

In the upper part between both side plates 1, 2, an upper hook 27 is disposed through a linkage 26. At the lower end of a load chain 28 wound around the load sheave 3, a lower hook 30 for suspending the load is coupled through a linkage 29. Numeral 31 is a load locking piece, and it is pivoted on the top of the lower hook 30 so as to be rotatable only inside.

The operation of thus composed lever-operated hoist is explained below.

Figure 6:
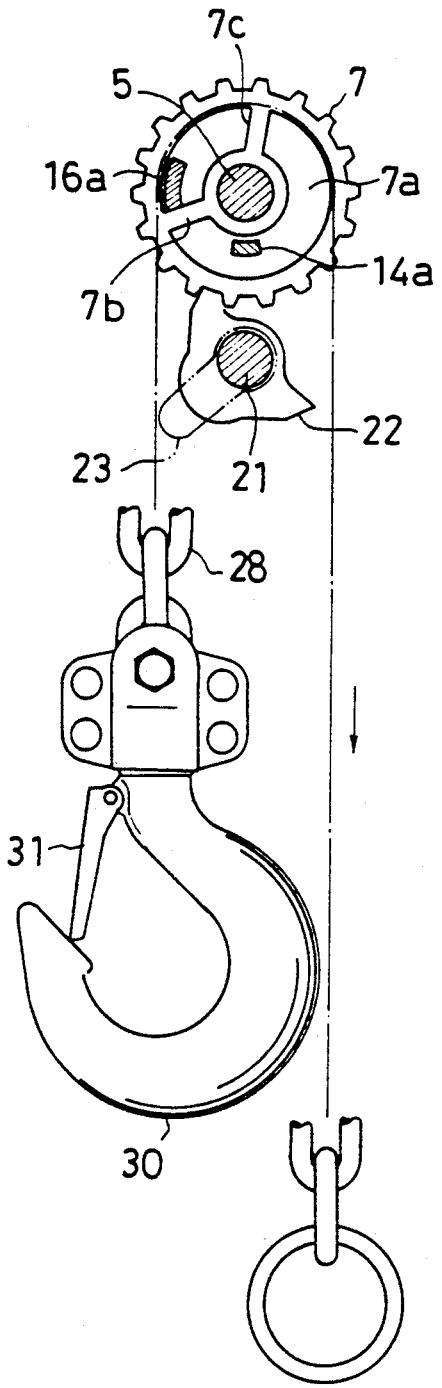
Figure 8:
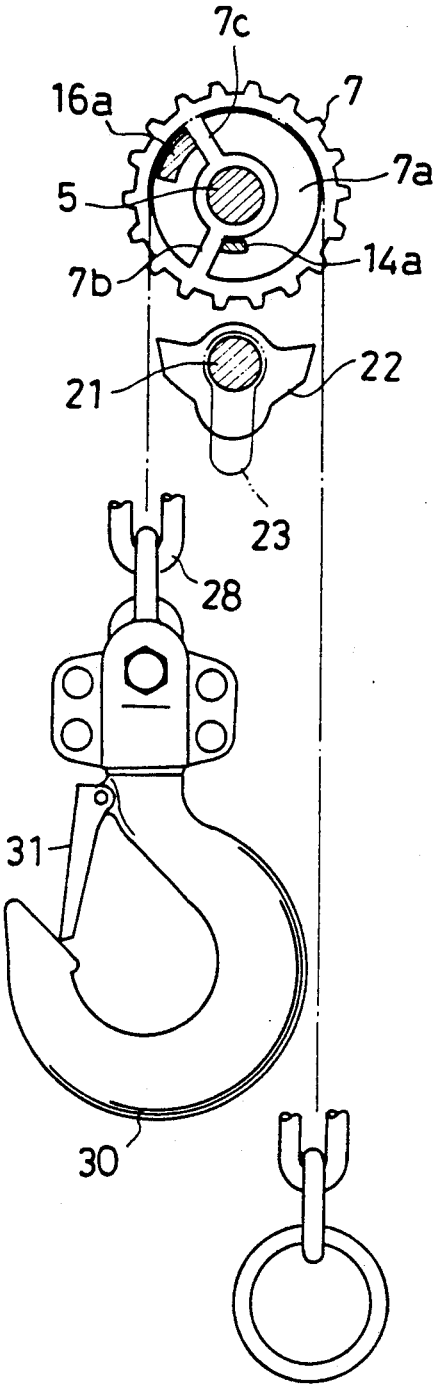

Hoisting-up action:

The rotating direction changeover pawl 22 is changed over from the neutral position shown in FIG. 8 to the hoisting-up position shown in FIG. 6, and the operation lever 18 is rotated reciprocally.

In consequence, the pressure drive member 7 is rotated and driven in the hoisting-up direction, and this rotating force is transmitted to the disk part 6*a* of the pressure bearing member 6 through the friction members 8, 9 and the reverse rotation preventive wheel 10. In turn, the drive shaft 5 which is integral with the pressure bearing member 6 is put into rotation, and the load sheave 3 is intermittently rotated in the hoisting-up direction through reduction gear transmission lines $G_2$, $G_3$, $G_4$, so that the load suspended on the lower hook 30 is hoisted up gradually.

In this case, the pressure release protuberance 16*a* of the operating wheel 16 rotatable on the rotation limiting member 14 is abutting against the first projection 7*b* of the pressure drive member 7 (FIG. 6).

Hoisting-down action:

The rotating direction changeover pawl 22 is changed over in the hoisting-down direction reversely to the case above (FIG. 7), and the operation lever 18 is rotated reciprocally.

In consequence, the pressure drive member 7 moves in the direction of going away from the pressure bearing member 6, no longer pressing the friction member 9, and therefore the drive shaft 5 and the pressure bearing member 6 are rotated in the hoisting-down direction by the weight of the load suspended on the lower hook 30. At this time, since the pressure drive member 7 is arrested of its rotation by the rotating direction changeover pawl 22, it is moved to the side of the pressure bearing member 6 by the relative rotation with the drive shaft 5, thereby acting to brake the disk part 6*a* of the pressure bearing member 6 through the friction members 8, 9 and the reverse rotation preventive wheel 10. As a result, the rotation in the hoisting-down direction of the drive shaft 5 is intermittently stopped, and the load suspended on the lower hook 30 is gradually hoisted down.

Figure 7:
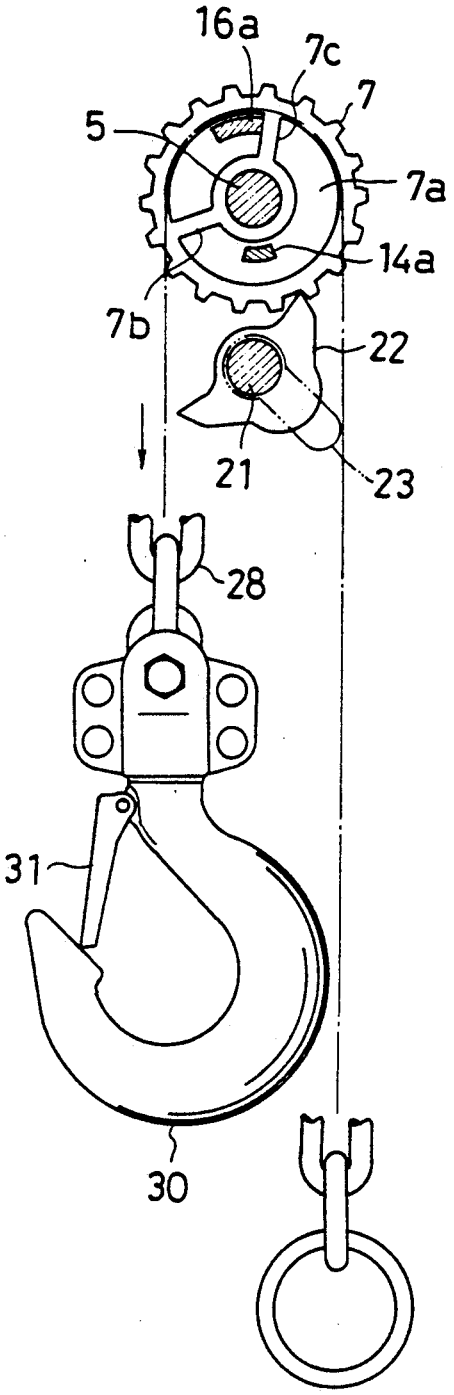

In this case, the pressure release protuberance 16*a* of the operating wheel 16 is in a state of abutting against the second projection 7*c* of the pressure drive member 7 (FIG. 7).

Pulling-down action of hook side chain in no-load state:

In no-load state, that is, while load is not suspended on the lower hook 30, when quickly pulling down the lower hook 30, the rotating direction changeover pawl 22 is changed over to the neutral position, and the operating wheel 16 is once turned idly in the clockwise direction to the full (FIG. 7), and the operating wheel 16 is quickly rotated in the counterclockwise direction which is the hoisting-down direction to release the pressurized state of the pressure drive member 7, then the chain of this lower hook 30 side is pulled down.

Figure 9:
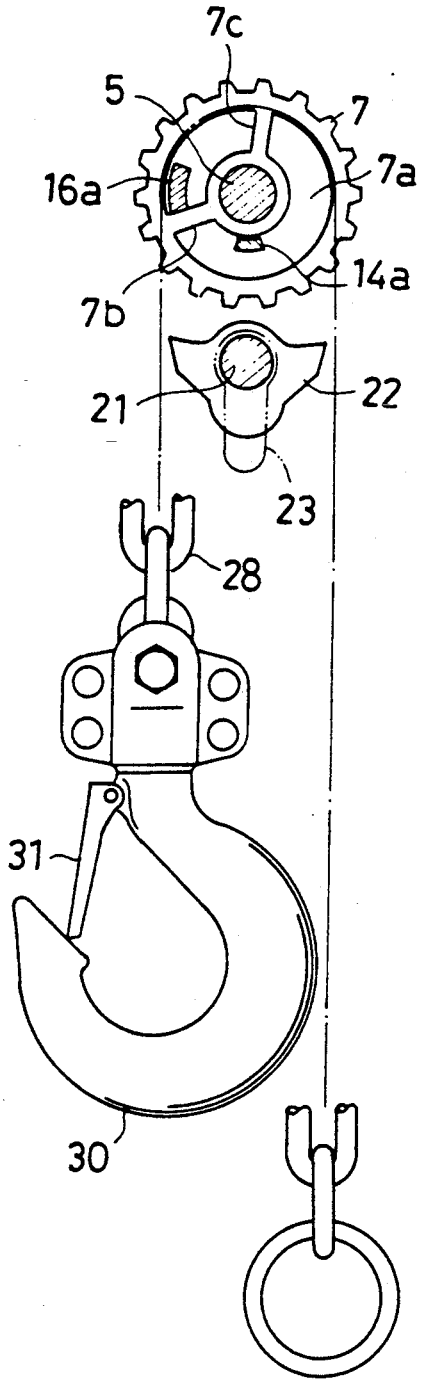
Figure 10:
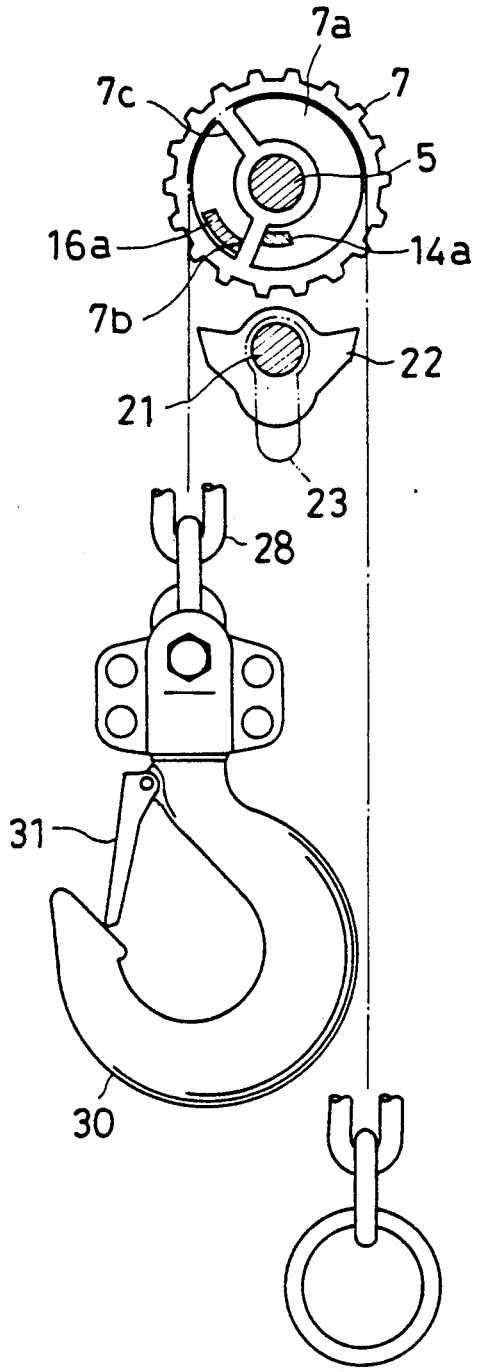

That is, in this case, when hoisting down the load, the pressure release protuberance 16*a* of the operating wheel 16 in the state as shown in FIG. 7 rotates idly on the rotation limiting member 14 and collides against the first projection 7*b* of the pressure drive member 7 (FIG. 9), thereby rotating the pressure drive member 7 in the counterclockwise direction. By this rotation and the thrusting force of the thrusting member 13, the pressure drive member 7 is weakened in the frictional force (contact force) with the friction member 9, and therefore by pulling down the lower hook 30 side chain, the lower hook 30 can be quickly returned to the specified position.

Meanwhile, in the midst of pulling down the hook side chain, as compared with the drive shaft 5, if the rotation of the pressure drive member 7 becomes weaker in the counterclockwise direction, the pressure drive member 7 rotates in the clockwise direction relatively to the drive shaft 5. As a result, the pressure drive member 7 moves on the drive shaft 5 toward the friction member 9 side, or contacts with other member, and its rotation is about to be stopped suddenly. Consequently, the drive shaft 5 to which the pressure drive member 7 is screwed, and the rotation limiting member 14 to which the drive shaft 5 is spline-fitted are about to stop their rotation instantly.

However, the operating wheel 16 rotatably fitted on the rotation limiting member 14 continues to rotate by the inertial action, and the pressure release protuberance 16*a*, which has been rotating as being pressed by the second projection 7*c* of the pressure drive member 7 (FIG. 7) collides against the first projection 7*b* of the pressure drive member 7 which has stop rotation.

By this collision force, the pressure drive member 7 is rotated again in the counterclockwise direction, and the same action is repeated, and hence the chain of the lower hook 30 side is continuously pulled down in succession.

Pulling-down action of end side chain in no-load state:

When the end side chain is pulled down in no-load state, the drive shaft 5 rotates in the clockwise direction as seen from the operating wheel 16 side, and the pressure drive member 7 moves to the rotation limiting member 14 side. However, this move is stopped when the rotation limiting protuberance 14*a* rotates about 30°, and abuts against the first projection 7*b* of the pressure drive member 7.

In this stopped state, the pressure drive member 7 is held so as not to contact with the end face of the rotation limiting member 14 or other members. Accordingly, afterwards, when the drive shaft 5, pressure drive member 7 and rotation limiting member 14 are rotated in the clockwise direction in assembly, the rotation does not become heavy due to frictional force, and the end side chain can be pulled down continuously to raise the lower hook 30 quickly to the specified position.

Still more, in this constitution, positioning of the rotation limiting protuberance 14*a* of the rotation limiting member 14 to the first projection 7*b* of the pressure drive member 7 is very easy because the first projection 7*b* is visible from outside.

Having such constitution, the invention brings about the following effects.

(1) In no-load state, after changing over the rotating direction changeover pawl to the neutral position, and rotating the operating wheel rotatably fitted in the rotation limiting member in the hoisting-down direction to release the pressurized state of the pressure drive member, when the lower hook side chain is pulled down, the pressure drive member is moved in the position remote from the friction member initially, and hence the lower hook side change can be pulled down.

In the midst of this pulling down, when the rotation of the pressure drive member is stopped due to inertia or the like, this pressure driving member moves in the direction of pressing the friction member, and the rotation of the drive shaft and rotation limiting member integrally coupled therewith is about to be stopped suddenly. However, the pressure release protuberance of the operating wheel continuing to rotate by the inertia collides against the first projection of the pressure drive member which is about to stop, thereby rotating the pressure drive member again in the hoisting-down direction, and by repeating this action the lower hook side change may be continuously pulled down.

(2) Or, in no-load state, when the end side chain is pulled down and the drive shaft is rotated in the hoisting-up direction, the pressure drive member, before receiving the frictional force by contacting with the end face of the rotation limiting member and other members, rotates together with the drive shaft and rotation limiting member after the second projection of the pressure drive member collides against the rotation limit protuberance of the rotation limiting member, so that the end side chain may be also pulled down continuously.

(3) Moreover, positioning of the rotation limiting member to the pressure drive member is very easy because it is effected on the first projection which is visible from outside so that the angle of the rotation limiting protuberance may be nearly equal to the preset value.

The foregoing embodiment exhibited in the detailed description of the invention herein is intended only to illustrate the technical content of the invention, and hence the invention should not be interpreted in a narrow sense by limiting to the above embodiment only, but should be interpreted in a wider sense as various changes and modifications are possible as far as not departing from the true spirit and scope of the claims of the invention.

What is claimed is:

1. A lever-operated hoist comprising:

a load sheave;

a gear transmission train;

a drive shaft linked to said load sheave by said gear transmission train, said drive shaft having a threaded part;

a pressure bearing member fixed on said drive shaft;

a ratchet wheel disposed on said pressure bearing member, said ratchet wheel being rotatable on said pressure bearing member;

pawl means for permitting said ratchet wheel to rotate in one direction only;

friction members disposed at both sides of said ratchet wheel;

a generally circular pressure drive member threadably engaging said threaded part of said drive shaft, said pressure drive member having an inner end face and an outer end face, said pressure drive member being rotatable and axially movable on said threaded part of said drive shaft in a hoisting-up direction and in a hoisting-down direction opposite said hoisting-up direction, and said pressure drive member being positioned opposite said pressure bearing member, said ratchet wheel and said friction members being interposed between said inner end face of said pressure drive member and said ratchet wheel;

direction changeover means for selectively setting said pressure drive member to rotate and move in said hoisting-up direction or said hoisting-down direction or to remain fixed in position;

operation lever means for rotating and moving said pressure drive member when said pressure drive member is set to rotate and move in said hoisting-up direction or said hoisting-down direction;

rotation limiting means for limiting rotation of said pressure drive member, said rotating limiting means comprising a wheel member spline-fitted on said drive shaft adjacent to said pressure drive member and having an outer periphery, an inner end face, and an outer end face, said inner end face facing said pressure driven member; and an operating wheel rotatably mounted on said outer periphery of said rotation limiting means, said operating wheel having an inner end face and an outer end face;

wherein said pressure drive member includes first and second radial projections extending from said outer end face opposite said rotation limiting means and said operating wheel, said first and second radial projections having a specific angular separation and defining first and second circumferential spaces in said pressure drive member;

wherein said rotation limiting means has a rotation limiting protuberance disposed at said inner end face thereof extending towards said outer end face of said pressure drive member;

wherein said operating wheel has a pressure release protuberance disposed at said inner end face thereof extending towards said outer end face of said pressure drive member; and wherein said rotation limiting protuberance and said pressure release protuberance are respectively inserted into said two circumferential spaces.

2. The lever-operating hoist of claim 1, wherein:

said first and second radial projections are centered on different diameters of said pressure drive member, whereby said first space has a smaller area than said second space;

said pressure release protuberance is inserted into said smaller area first space and said rotation limiting protuberance is inserted into said second space; and said rotation limiting protuberance and said first projection being positioned to abut against each other before said outer end face of said pressure drive member makes contact with said inner end face of said rotation limiting means when said pressure drive member rotates and moves in said hoisting-down direction.

3. The lever-operated hoist of claim 1, wherein:

said pressure drive member includes an annular hole disposed in said outer end face opposite said rotation limiting member and said operating wheel; and said first and second projections are disposed in said annular hole.

4. The lever-operated hoist of claim 1, further comprising thrusting means for biasing said pressure drive member away from said pressure bearing member, said thrusting means being interposed between said pressure bearing member and said pressure drive member.

* * * * *